US006505821B1

(12) United States Patent
Edmonston

(10) Patent No.: US 6,505,821 B1
(45) Date of Patent: Jan. 14, 2003

(54) CARBURETOR

(76) Inventor: William H. Edmonston, 19134 Elm Dr., Apple Valley, CA (US) 92308

( * ) Notice: Subject to any disclaimer, the term of this patent is extended or adjusted under 35 U.S.C. 154(b) by 0 days.

(21) Appl. No.: 09/787,769

(22) PCT Filed: Oct. 7, 1999

(86) PCT No.: PCT/US99/23431

§ 371 (c)(1),
(2), (4) Date: Mar. 22, 2001

(87) PCT Pub. No.: WO00/20750

PCT Pub. Date: Apr. 13, 2000

Related U.S. Application Data

(60) Provisional application No. 60/103,459, filed on Oct. 7, 1998, and provisional application No. 60/118,421, filed on Feb. 2, 1999.

(51) Int. Cl.[7] ..... F02M 9/06

(52) U.S. Cl. ..... 261/44.3; 261/44.4; 261/49; 261/50.1; 261/DIG. 56

(58) Field of Search ..... 261/44.3, 44.4, 261/49, 50.1, 66, 69.1, DIG. 56

(56) References Cited

U.S. PATENT DOCUMENTS

| | | | | |
|---|---|---|---|---|
| 1,971,494 A | | 8/1934 | Lesage | 261/44.3 |
| 3,307,837 A | | 3/1967 | Winkler | 261/44.4 |
| 4,150,070 A | | 4/1979 | Hashimoto et al. | 261/44.3 X |
| 4,459,243 A | * | 7/1984 | Nakamura et al. | 261/44.4 |
| 4,464,311 A | * | 8/1984 | Nakamura et al. | 261/44.4 |
| 4,465,642 A | * | 8/1984 | Nakamura et al. | 261/44.4 |
| 4,530,805 A | * | 7/1985 | Abbey | 261/DIG. 56 |
| 4,620,951 A | | 11/1986 | Makino et al. | 261/44.3 |
| 5,342,555 A | | 8/1994 | Edmonston | 261/44.3 |
| 5,538,673 A | | 7/1996 | Edmonston | 261/44.3 |

* cited by examiner

*Primary Examiner*—Richard L. Chiesa
(74) *Attorney, Agent, or Firm*—Nixon & Vanderhye, P.C.; Frank P. Presta

(57) ABSTRACT

A carburetor for an internal combustion engine including a body having an air inlet opening and air outlet opening. A throat is disposed in the body between the air inlet and outlet openings. A slide assembly is movably disposed in the body for crosswise movement across the throat. The slide assembly includes a stepped portion upstream of the throat and the lower portion of the air inlet opening is narrowed for concentrating and compressing the air entering the throat. A reservoir containing fuel is attached to the body. The fuel reservoir includes a fuel outlet located in the throat. An adjustable metering rod extends through the slide assembly and throat into the fuel reservoir. A recessed scoop is located in the body above the air inlet opening and is in air flow communication with the fuel reservoir. An air supply tube extends from the scoop to the fuel reservoir and is provided with a cone-shaped cavity and float ball therein to prevent the flow of fuel into the air supply tube if the fuel level rises in the reservoir.

17 Claims, 8 Drawing Sheets

*Fig. 13*
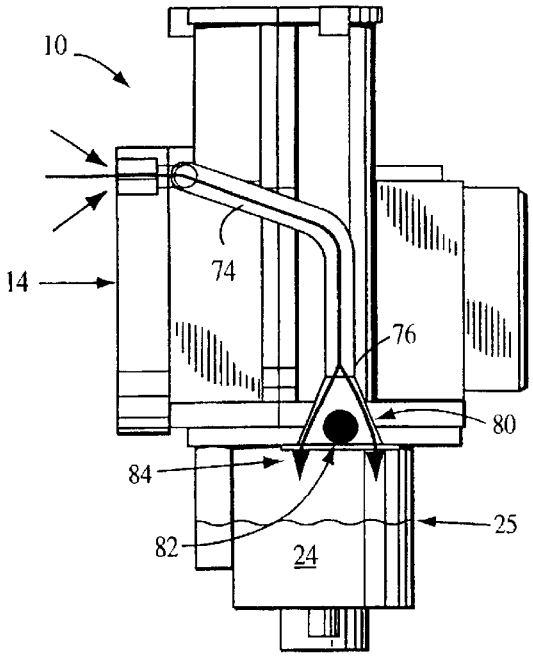
*Fig. 14*
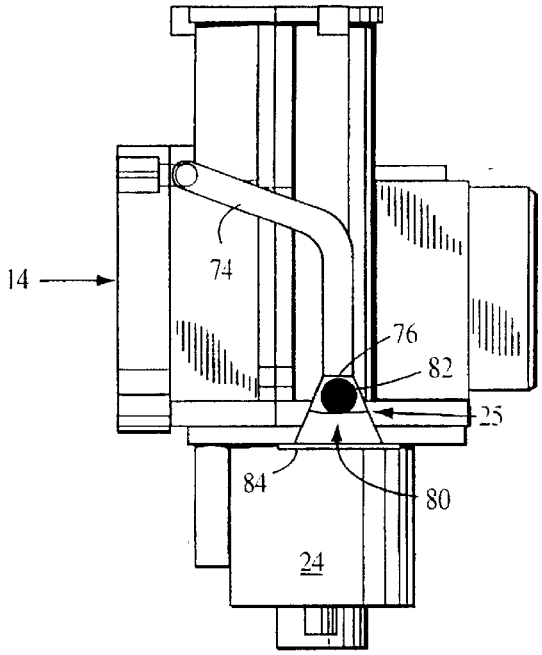
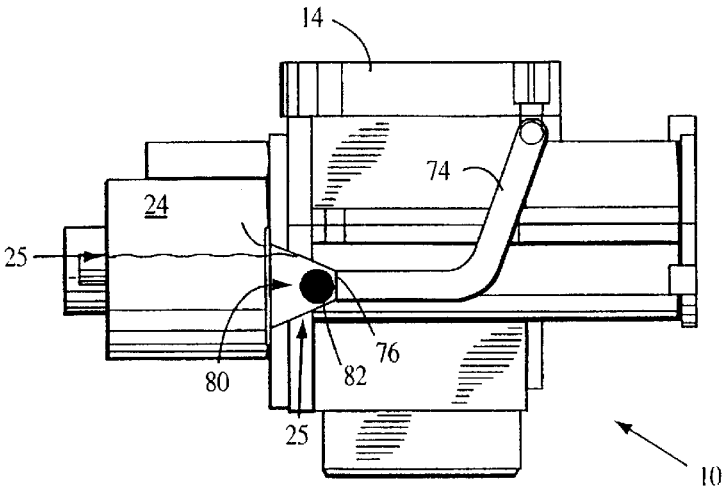
*Fig. 15*

CARBURETOR

The present application is based on Provisional Application No. 60/103,459, entitled CARBURETOR CONSTRUCTION, filed Oct. 7, 1998 and Provisional Application No. 60/118,421 entitled FUEL OVERFLOW VALVE filed on Feb. 2, 1999.

BACKGROUND OF THE INVENTION

1. Field of the Invention

The present invention relates to a carburetor for an internal combustion engine, and more particularly to a carburetor having a slide portion which compresses the air flow entering the air inlet and a screw adjusting assembly.

2. Description of the Related Art

Carburetors having a metering rod assembly and slide are known. As disclosed in U.S. Pat. No. 5,538,673, carburetor adjustment screw devices allow for precise delivery of fuel to adjust performance of the carburetor. Slide 22 is partially angled at its lower surface. However, the slide is not configured to adequately compress and accelerate the air as it passes underneath the slide.

It is also known to utilize devices (see U.S. Pat. No. 4,530,805) or projections (see U.S. Pat. Nos. 4,459,243; 4,464,311; and 4,465,642) within the venturi of a carburetor to vary the flow therethrough.

There is a need for a carburetor of this type which includes a slide portion for increasing the velocity of the air flow past the slide portion to effect thorough mixing of the incoming fuel with the air and efficient burning of the fuel-air mixture.

SUMMARY OF THE INVENTION

An object of the present invention is to effect thorough mixing of the incoming fuel with the air and efficient burning of the fuel-air mixture by forcing the incoming air to compress before traveling under the slide, thereby increasing the velocity of the air flours past the slide and fuel inlet to the throat of the venturi.

Another object of the present invention is to concentrate and accelerate air flow past the lower portion of the slide and fuel inlet to the throat by narrowing the lower portion of the carburetor air inlet.

A further object of the present invention is to maintain a steady atmospheric pressure on the fuel in the float bowl, thereby generating uniform fuel flow and efficient mixing of the fuel with incoming air by providing air inlet openings and a scoop in the upper portion of the air inlet. The scoop serves to trap the air in a relatively stagnant, non-turbulent state at the entrance to the inlet openings to maintain a constant pressure on the fuel in the float bowl.

Still another object of the present invention is to provide a smooth surface for the air flow to reduce turbulence of the air passing under the slide by forming the lower surface of the slide substantially flush with the front and rear surfaces thereof.

Another object of the invention is to eliminate fuel overflow if the float bowl should become excessively filled or a disturbance in the vertical position of the float bowl occurs. A conical shaped orifice containing a closed-cell or similar material ball is provided. When the ball reaches the top of the orifice it creates a seal restricting the fuel from escaping the float bowl.

In accomplishing these and other objectives of the present invention, there is provided a carburetor for an internal combustion engine including a body having an air inlet end and an air outlet. A throat is disposed in the body between the air inlet and outlet. A slide assembly is movably disposed in the body for crosswise movement across the throat. A float bowl containing fuel is attached to the body. The float bowl includes a fuel outlet located in the throat. An adjustable metering rod extends through the slide assembly and throat into the float bowl. A spring assembly is located within the slide assembly for adjusting the position of the slide assembly to control the flow of air and fuel entering the body.

Other features and advantages of the present invention will become apparent from the following descriptions of the invention which refers to the accompanying drawings.

BRIEF DESCRIPTION OF THE DRAWINGS

FIG. 13 is a cross-sectional side view of the fuel overflow valve of the carburetor of the present invention.

FIG. 14 is a cross-sectional view of the fuel overflow valve in a condition of high fuel level.

FIG. 15 is a cross-sectional view of the carburetor and fuel overflow valve in a non-vertical position.

DETAILED DESCRIPTION OF THE PREFERRED EMBODIMENTS

Figure 2:
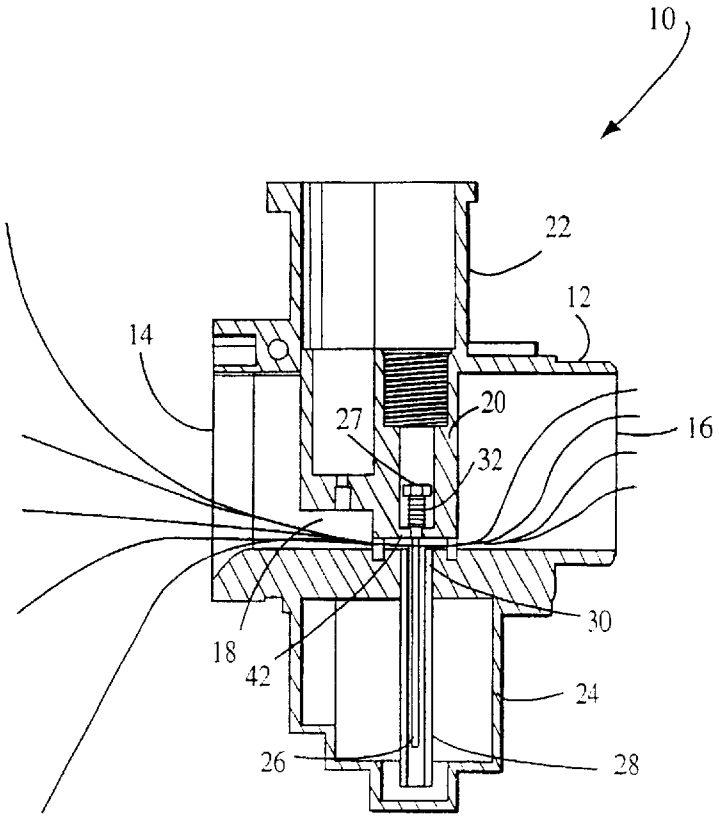
FIG. 2 is a cross-sectional view of the carburetor taken along line I—I of FIG. 1.
Figure 1:
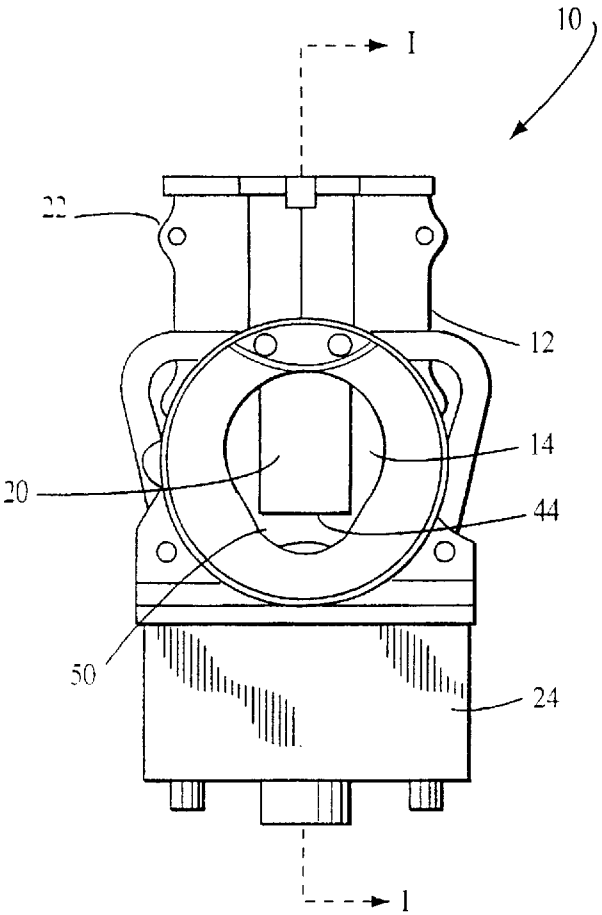
FIG. 1 is a front plan view of the carburetor of the present invention in an idle condition.

Referring to FIGS. 1 and 2, the carburetor of the present invention is shown in an idle state of operation. Carburetor 10 comprises a body 12 having an air inlet end 14 and an air outlet end 16. A throat 18 extends between inlet 14 and outlet 16 and provides a venturi air passage for the air entering and exiting the carburetor.

Centrally disposed in throat 18 is a slide assembly 20. Slide assembly 20 moves crosswise across throat 18 within slide support 22 of body 12. The movement of slide assembly 20 will be described further herein. A float bowl or chamber 24 is secured to body 12 beneath slide assembly 20. Float bowl 24 contains a quantity of fuel which is delivered to the throat 18 through a fuel inlet 30 by the movement of a metering rod 26.

As shown in FIG. 2, metering rod 26 is adjustably secured and extends downwardly from slide assembly 20 into a fuel supply tube 28. Metering rod 26 has an enlarged head portion 27 which is slidably received within a lower bore 48 (FIG. 3) of slide assembly 20. The position of rod 26 within slide assembly 20 can be adjusted by known means and will not be described further herein. Metering rod head 27 is biased upwardly by action of a spring 32.

Figure 3:
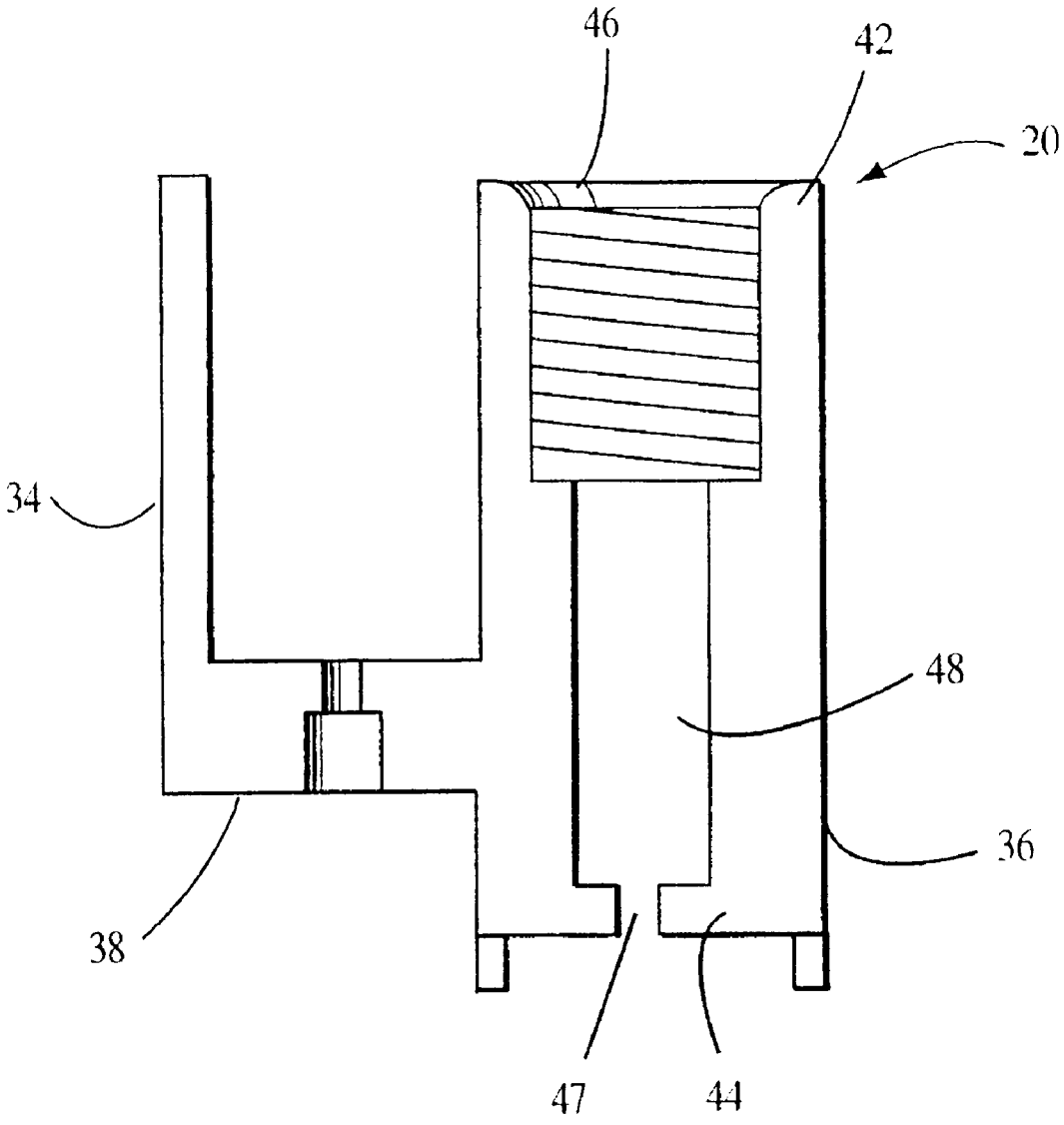
FIG. 3 is a cross-section of the slide assembly of the present invention.

Referring to FIG. 3, slide assembly 20 will be described in detail. Slide assembly 20 includes a spring retainer portion 34 and a metering rod portion 36 connected therewith. Spring retainer portion 34 is stepped upwardly, designated by numeral 38. The stepped portion 38 forces air entering from inlet 14 to compress before going under slide assembly 20, thereby increasing the velocity of the air flow past the slide and fuel outlet 29. This is especially effective for the thorough mixing of incoming fuel and air and efficient burning of the fuel-air mixture at low settings of the carburetor.

Metering rod portion 36 includes an upper and towel end 42, 44 respectively. A first bore 46 is located in upper end-42 and a second bore 48 is located in lower end 44. Metering, rod 26 extends through an opening 47 in lower end 44 into bore 48. As shown in FIG. 3, lower end 44 of slide 20 is flat such that its surface is formed substantially flush with the front and rear faces thereof. End 44 provides a smooth surface for the air flow thus reducing turbulence of the air passing under the slide.

Referring again to FIG. 1, air inlet 14 includes a narrowed lower portion 50 which concentrates and accelerates the air flow past the lower end 44 of slide 20 and fuel inlet 30. This concentrating and accelerating, of the air flow at lower portion 50 is particularly effective at low settings of the carburetors, which also effects thorough mixing of the fuel and air causing effective burning of the mixture.

Slide assembly 20 is actuated via any suitable means such as a cable (not shown) to move upwardly and downwardly across throat 18 controlling the air flow from inlet 14 across the lower surface 44 of the slide to the outlet 16.

Figure 5:
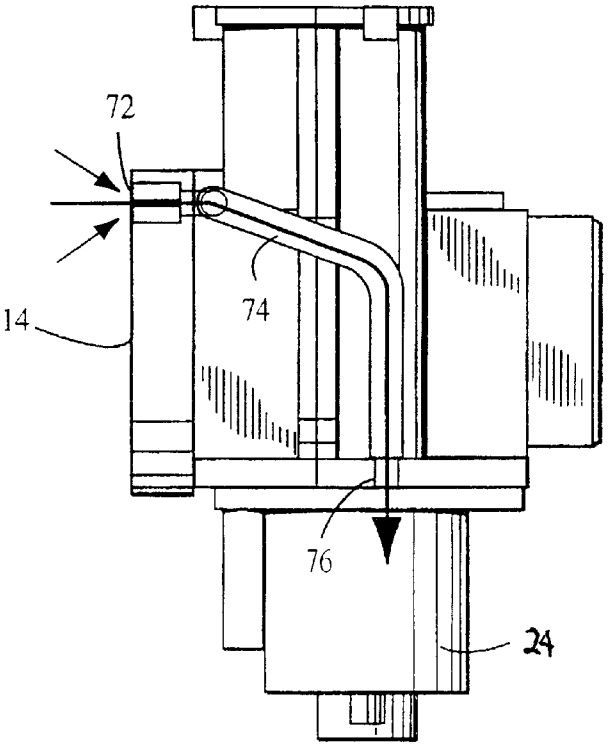
FIG. 5 is a cross-sectional view taken along line II—II of FIG. 4.
Figure 4:
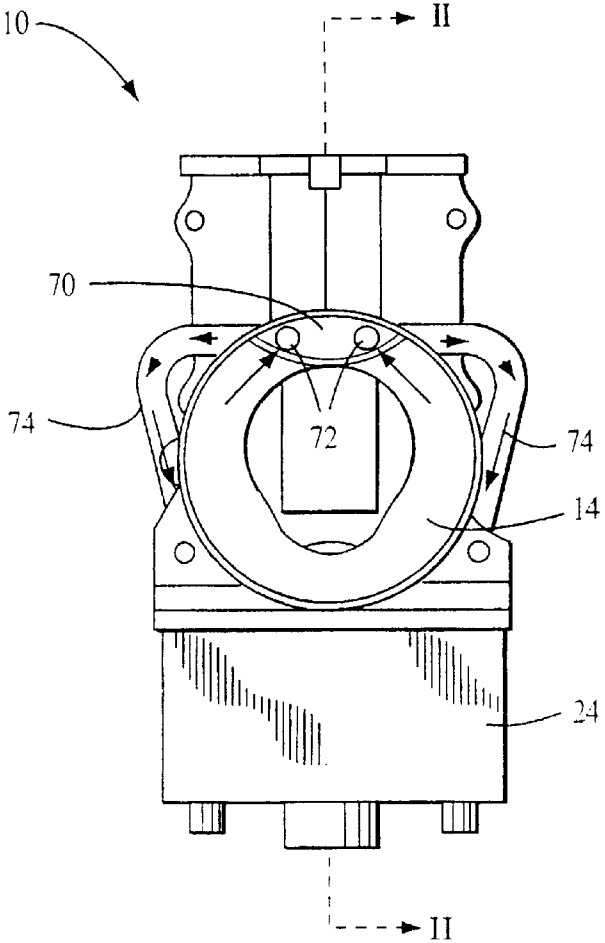
FIG. 4 is a front elevational view of the carburetor of the present invention in an idle condition illustrating the air flow through the scoop in the air inlet.

As shown in FIGS. 4 and 5, body 12 includes a scoop 70 in an upper portion thereof above air inlet 14. Scoop 70 includes air intakes 72 of the air supply tubes 74. As shown by the arrows, air enters tubes 74 through intakes 72 and travels down the tubes exiting via the tube ends 76 into float bowl 24 to pressurize the same. The air intakes 72 and scoop 70 maintain a steady atmospheric pressure on the fuel in the float bowl thereby generating uniform fuel flow and efficient mixing of the fuel with the incoming air. Scoop 70 also serves to trap the air in a relatively stagnant, non-turbulent state at the entrance to air intakes 72 to maintain a constant pressure on the fuel in float bowl 24.

Figure 7:
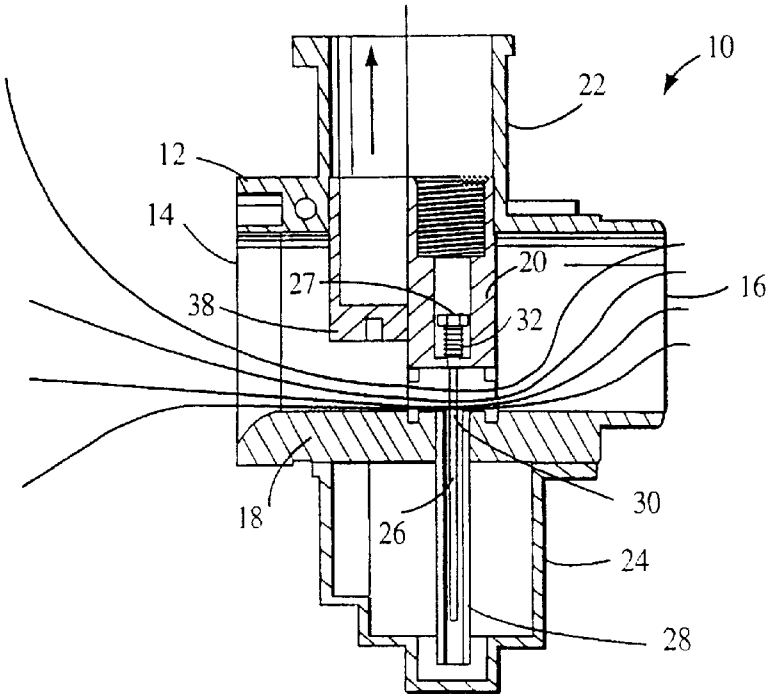
FIG. 7 is a cross-sectional view of the carburetor taken along line III—III of FIG. 6.
Figure 6:
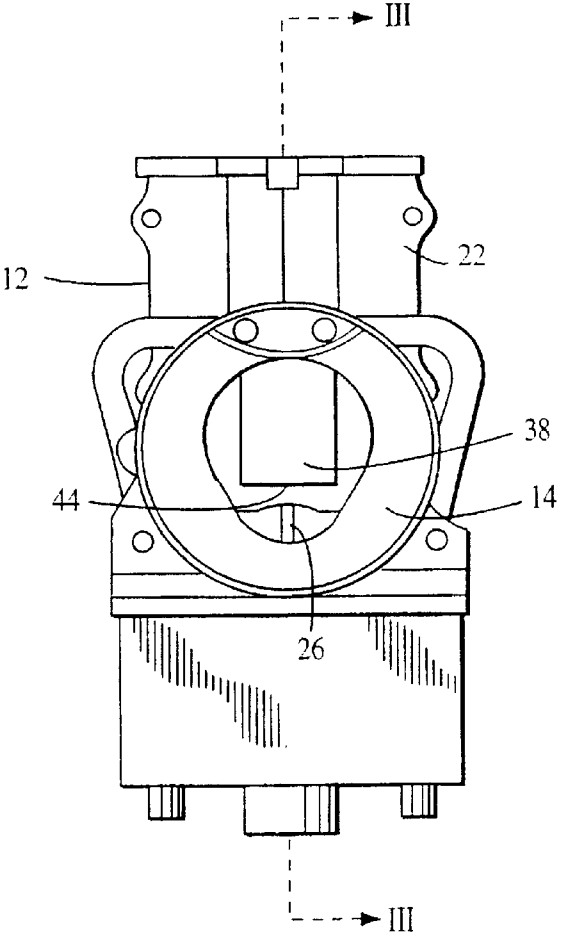
FIG. 6 is a front elevational view of the carburetor of the present invention at ¼ throttle speed.
Figure 9:
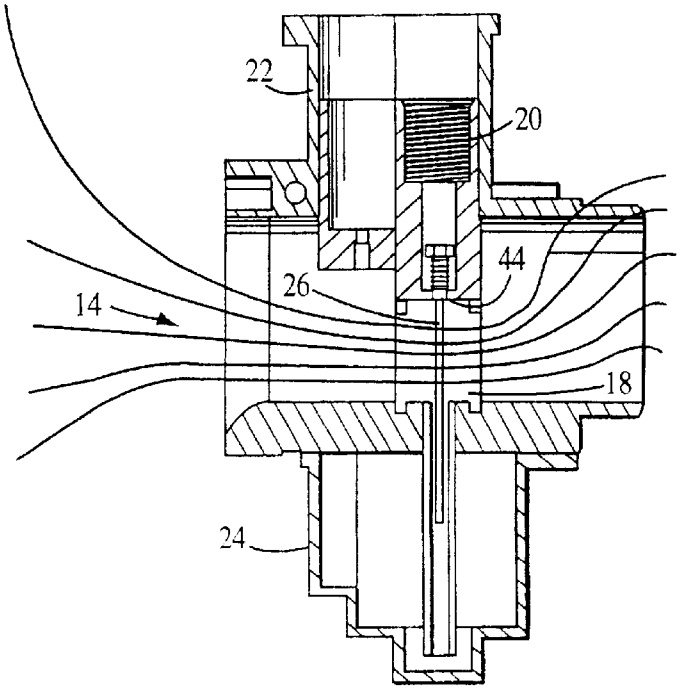
FIG. 9 is a cross-sectional view of the carburetor taken along line IV—IV of FIG. 8.
Figure 8:
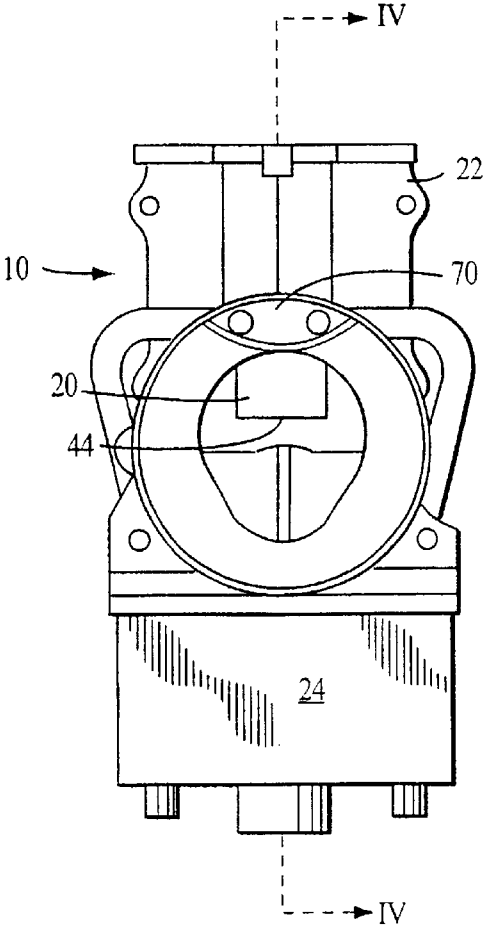
FIG. 8 is a front elevational view of the carburetor of the present invention at ½ throttle.
Figure 11:
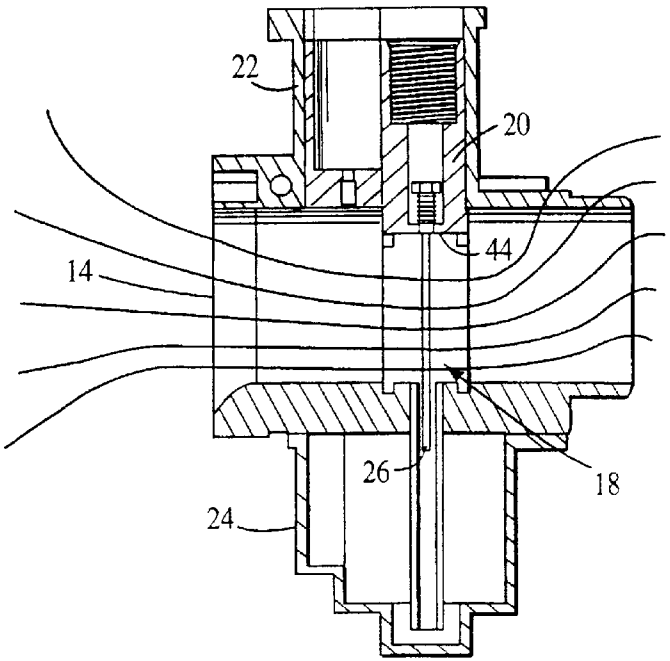
FIG. 11 is a cross-sectional view of the carburetor taken along line V—V of FIG. 10.
Figure 10:
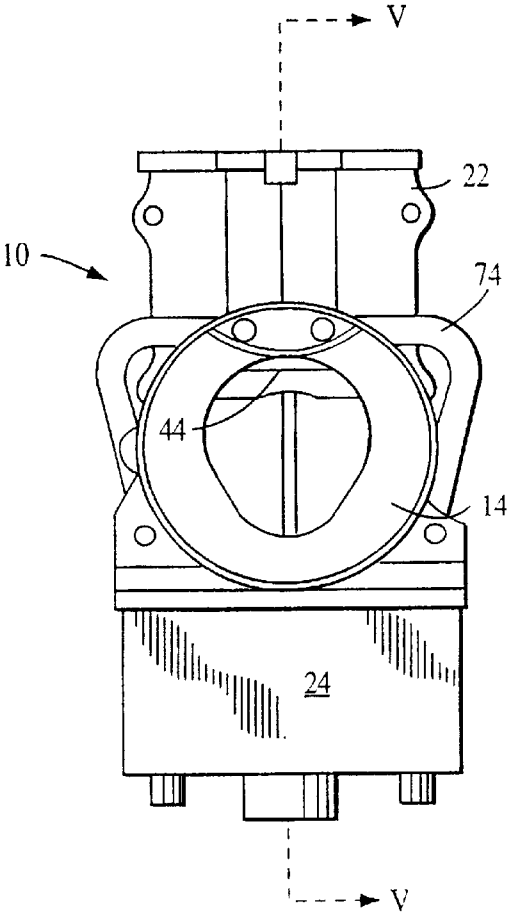
FIG. 10 is a front plan view of the carburetor of the present invention at ¾ throttle.
Figure 12:
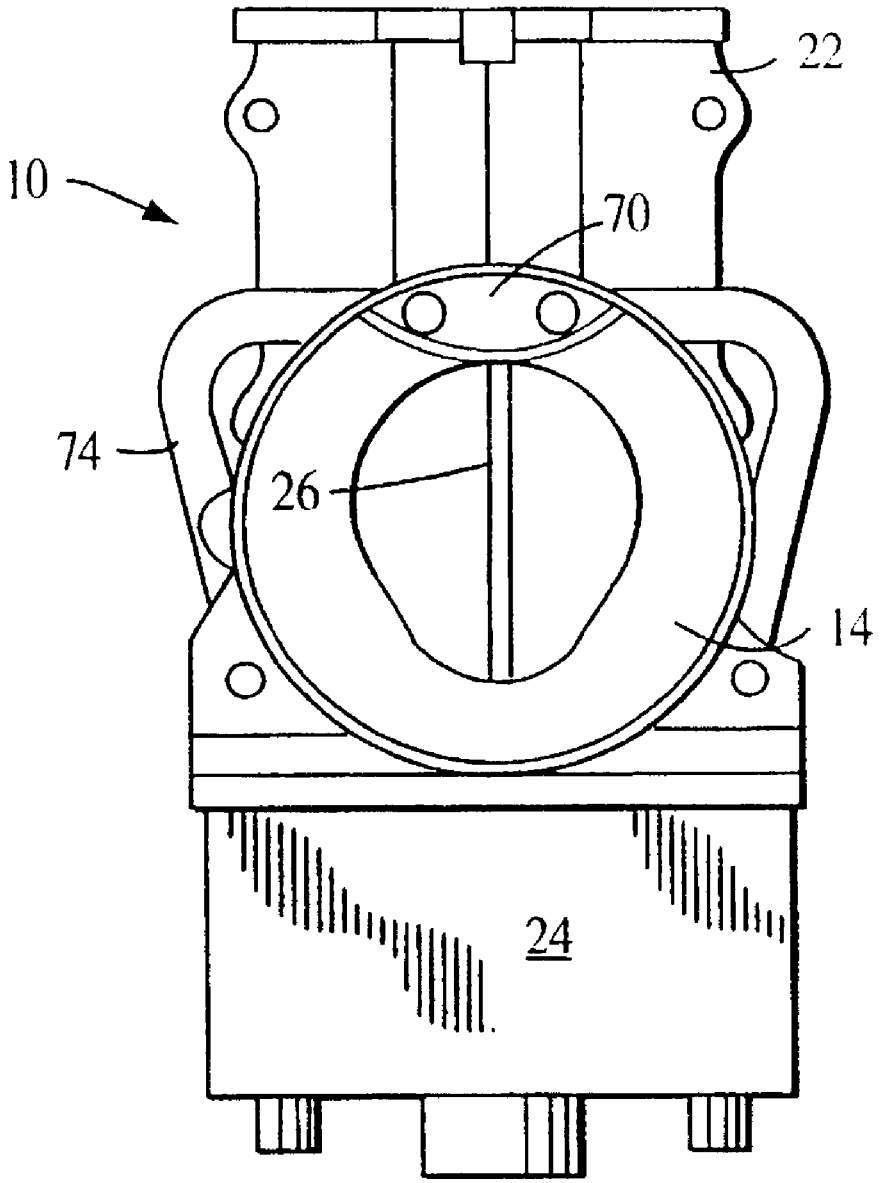
FIG. 12 is a front elevational view of the carburetor of the present invention at full throttle.

When the engine is at idle speed, as shown in FIGS. 1 and 2, lower end 44 of slide 20 extends almost entirely across throat 18 allowing a minimum of air flow across slide 20 and fuel inlet 30. At approximately ¼ throttle as shown in FIGS. 6 and 7, slide 20 has moved upward and air flow across slide 20 and fuel inlet 30 is increased. The stream of air passing through the venturi passageway is intermixed with the fuel to a mixture having the desired air-fuel ratio. At approximately ½ throttle, as shown in FIGS. 8 and 9, slide 20 is advanced across throat 18 and upwards into slide support 22. Likewise. during approximately ¾ throttle, as shown in FIGS. 10 and 11, the venturi air passageway is almost completely opened allowing for increased air flow and fuel delivery. In FIG. 12, which illustrates full engine throttle, the air passageway is completely opened.

Referring to FIGS. 13–15, the carburetor of the present invention includes a fuel overflow valve. As shown in FIG. 13, the ends 76 of the air supply tubes 74 terminate in conical shaped cavities 80. Disposed within each cavity 80 is a float ball 82. Ball 82 can be a closed cell ball or made of a similar or another suitable material. When the fuel level 25 rises, as shown in FIG. 14, ball 82 moves upward into cavity 80 creating a seal which restricts the fuel from entering air supply tube 74. Likewise, when the fuel level 25 recedes, as shown in FIG. 13, ball 82 will resume its normal resting position at the largest opening of cavity 80.

To prevent ball 82 from falling into float bowl 24 a perforated retaining plate or the like is located within cavity 80. Plate 84 can be a stamped plate or any other mechanically equivalent device. Because plate 84 is perforated the air entering tubes 74 can enter float bowl 24 to pressurize the same. Ball 82 eliminates fuel overflow if float bowl 24 becomes excessively full or if a disturbance in the vertical position of the float bowl occurs, as shown in FIG. 15.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A carburetor for an internal combustion engine comprising:

a body having an air inlet opening and an air outlet opening;

a throat disposed in the body between the air inlet and outlet openings;

a slide assembly movably disposed in the body for crosswise movement across the throat;

a fuel reservoir containing fuel in communication with the body, the reservoir including a fuel outlet located in the throat;

an adjustable metering rod extending through the slide assembly and throat and into the reservoir; and a spring assembly located within the slide assembly for adjusting the position of the slide assembly to control the flow of air and fuel entering the body;

the air inlet opening including a lower portion that is narrower in width than the upper portion thereof for concentrating and accelerating air flow past the lower end of the slide assembly.

2. The carburetor of claim 1, wherein the slide assembly includes a stepped portion upstream of the throat for concentrating and compressing the air entering the throat.

3. The carburetor of claim 2, wherein the slide assembly includes a spring retainer portion disposed above the stepped portion.

4. The carburetor of claim 3, wherein the spring assembly is located within the spring retainer portion.

5. The carburetor of claim 4, wherein the slide assembly includes a metering rod portion.

6. The carburetor of claim 5, wherein the metering rod portion has a first and second end.

7. The carburetor of claim 6, further comprising an upper bore located in the first end of the metering rod portion and a lower bore located within the second end of the metering rod portion, wherein the metering rod extends into the lower bore.

8. The carburetor of claim 6, wherein the second end of the metering rod portion extends into the throat and is substantially flat for reducing turbulence of the air that passes underneath.

9. The carburetor of claim 1 wherein the lower surface of said slide assembly is substantially flush with the front and rear surfaces thereof to provide a smooth lower surface to reduce turbulence of the air flow past it.

10. A carburetor for an internal combustion engine comprising:

a body having an air inlet opening and an air outlet opening;

a throat disposed in the body between the air inlet and outlet openings;

a slide assembly movably disposed in the body for crosswise movement across the throat;

a fuel reservoir containing fuel in communication with the body, the reservoir including a fuel outlet located in the throat;

an adjustable metering rod extending through the slide assembly and throat and into the reservoir; and a spring assembly located within the slide assembly for adjusting the position of the slide assembly to control the flow of air and fuel entering the body;

the body including a recessed scoop in an upper portion thereof above the air inlet opening which traps air in a relatively stagnant, non-turbulent state therein, said scoop being in air flow communication with the fuel reservoir.

11. The carburetor of claim 10, further comprising at least one air supply tube having opposing ends, one end of the air supply tube being located within the scoop and the other end of the air supply tube being located within the fuel reservoir, whereby air enters through the scoop and travels down the air supply tube to maintain pressure in the fuel reservoir.

12. The carburetor of claim 11 wherein a second air supply tube has one end located within the scoop and the other end located within the fuel reservoir, said one and said second air supply tubes being disposed on opposite sides of the carburetor body.

13. The carburetor of claim 11, wherein the other end of the at least one air supply tube terminates in a cone-shaped cavity that opens outwardly into the fuel reservoir.

14. The carburetor of claim 13, further comprising a float ball disposed within the cone-shaped cavity, whereby when the fuel level rises the float ball is forced into the narrow cavity to close the one air supply tube and prevent fuel from entering the air supply tube.

15. The carburetor of claim 14, further comprising a perforated retaining plate located near the wide end of the cavity for preventing the float ball from falling into the fuel reservoir.

16. A carburetor for an internal combustion engine comprising:

a body having an air inlet opening and an air outlet opening;

a throat disposed in the body between the air inlet and outlet openings;

a slide assembly movably disposed in the body for crosswise movement across the throat;

a fuel reservoir containing fuel in communication with the body, the reservoir including a fuel outlet located in the throat;

an adjustable metering rod extending through the slide assembly and throat and into the reservoir;

a spring assembly located within the slide assembly for adjusting the position of the slide assembly to control the flow of air and fuel entering the body; and at least one air supply tube having one end disposed adjacent the air inlet opening and the other end located within the fuel reservoir, said other end terminating in a cone-shaped cavity that opens outwardly into said reservoir, and a float ball disposed within said cavity, whereby when the fuel level rises in said reservoir said float ball is forced into the narrow cavity end to close said air supply tube and prevent fuel from entering said air supply tube.

17. The carburetor of claim 16, further comprising a perforated retaining plate located near the wide end of said cavity for preventing the float ball from falling into the fuel reservoir.

* * * * *